US008376587B2

(12) United States Patent
Liu

(10) Patent No.: US 8,376,587 B2
(45) Date of Patent: Feb. 19, 2013

(54) LED ILLUMINATING DEVICE AND LIGHT ENGINE THEREOF

(75) Inventor: Tay-Jian Liu, Taipei Hsien (TW)

(73) Assignee: Foxconn Technology Co., Ltd., New Taipei (TW)

( * ) Notice: Subject to any disclaimer, the term of this patent is extended or adjusted under 35 U.S.C. 154(b) by 390 days.

(21) Appl. No.: 12/480,633

(22) Filed: Jun. 8, 2009

(65) Prior Publication Data

US 2010/0149799 A1 Jun. 17, 2010

(30) Foreign Application Priority Data

Dec. 12, 2008 (TW) ..... 97148444 A

(51) Int. Cl.
*F21V 29/00* (2006.01)

(52) U.S. Cl. .... 362/294; 362/373; 362/800; 362/249.02

(58) Field of Classification Search ..... 362/126, 362/218, 249.02, 373, 547, 580, 294; 257/E23.088; 165/104.33
See application file for complete search history.

(56) References Cited

U.S. PATENT DOCUMENTS

| | | | | |
|---|---|---|---|---|
| 7,110,259 | B2 * | 9/2006 | Lee et al. | 361/700 |
| 7,182,627 | B1 * | 2/2007 | Huang | 439/487 |
| 7,438,448 | B2 * | 10/2008 | Chen | 362/373 |
| 7,612,383 | B2 * | 11/2009 | Andrews et al. | 257/98 |
| 7,722,217 | B2 * | 5/2010 | Chen | 362/249.02 |
| 2004/0134642 | A1 * | 7/2004 | Lo | 165/104.21 |
| 2007/0041195 | A1 * | 2/2007 | Chen | 362/294 |
| 2007/0145572 | A1 * | 6/2007 | Chen et al. | 257/718 |
| 2008/0043472 | A1 * | 2/2008 | Wang | 362/294 |

FOREIGN PATENT DOCUMENTS

| | | | |
|---|---|---|---|
| CN | 2881340 | Y | 3/2007 |
| CN | 200982536 | Y | 11/2007 |
| CN | 201028443 | Y | 2/2008 |

* cited by examiner

*Primary Examiner* — Jason Moon Han
*Assistant Examiner* — Jessica M Apenteng
(74) *Attorney, Agent, or Firm* — Altis Law Group, Inc.

(57) ABSTRACT

An LED illuminating device includes an optical section at a bottom end thereof, an electrical section at a top end thereof and a heat dissipation section between the optical section and the electrical section. The optical section includes an LED emitter. The electrical section electrically connects with the LED emitter. The heat dissipation section includes an upper substrate, a lower substrate being parallel to and spaced from the upper substrate, a plurality of fins arranged between the upper and lower substrates and a heat pipe. The heat pipe includes an evaporating section connected to the lower substrate and a condensing section connected to the upper substrate. The LED emitter is attached to the lower substrate and thermally connects therewith. The heat pipe is transfers heat of the LED emitter from the lower substrate to the upper substrate.

8 Claims, 5 Drawing Sheets

LED ILLUMINATING DEVICE AND LIGHT ENGINE THEREOF

BACKGROUND

1. Technical Field

Embodiments of the present disclosure generally relate to light emitting diode (LED) illuminating devices, and particularly to an LED illuminating device and a light engine thereof with high heat dissipating efficiency.

2. Description of Related Art

Presently, LEDs (light emitting diodes) are preferred for use in illuminating devices rather than CCFLs (cold cathode fluorescent lamps) due to high brightness, long lifespan, and wide color range.

For an LED, 80%-90% of the power consumed by the LED is converted into thermal energy, with only 10%-20% of the power consumed converted to light. In addition, a plurality of LEDs must be packaged in a single LED illuminating device to obtain a desired brightness.

Thus, heat dissipation is necessary to maintain brightness, lifespan, and reliability of the LED illuminating device.

DETAILED DESCRIPTION

Figure 1:
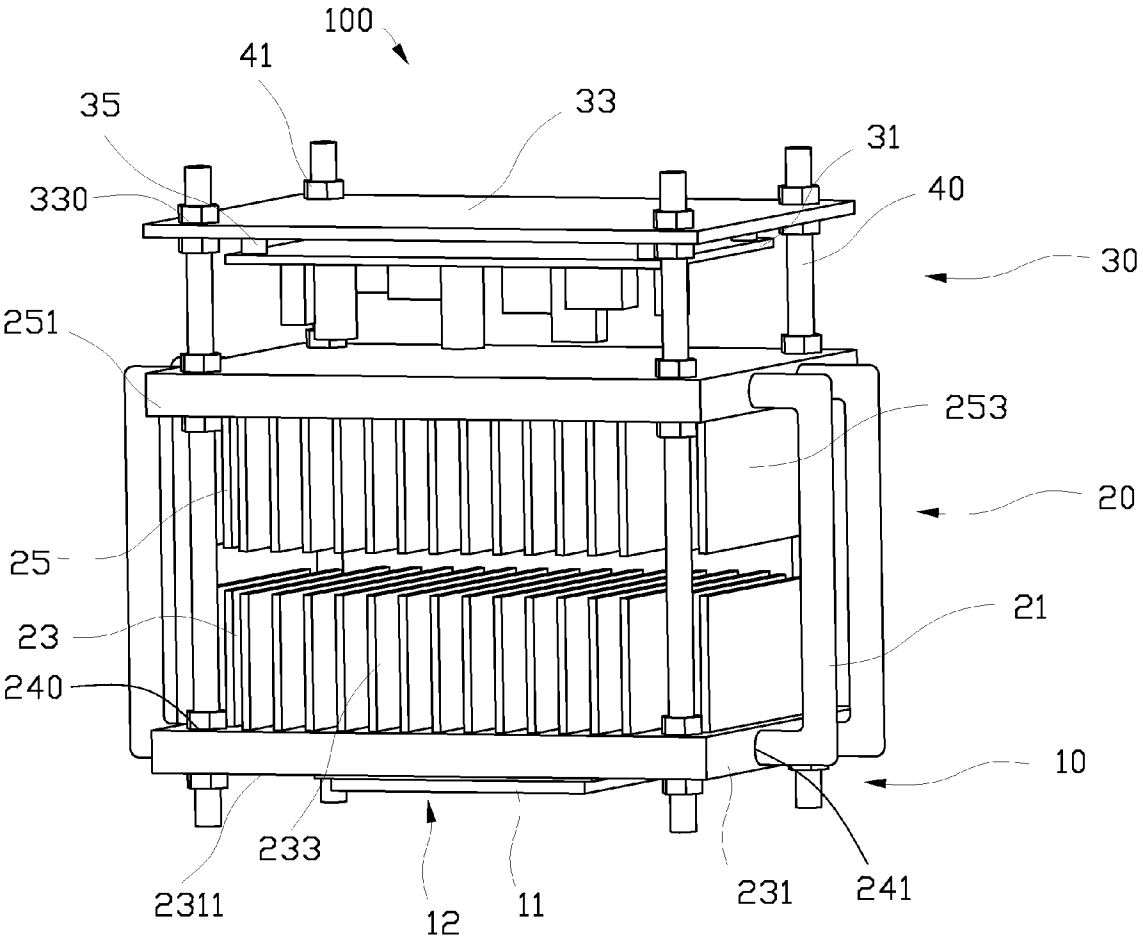
FIG. 1 is an assembled, isometric view of an LED illuminating device in accordance with a first embodiment.

Reference will now be made to the drawing figures to describe the present LED illuminating device in detail.

Figure 2:
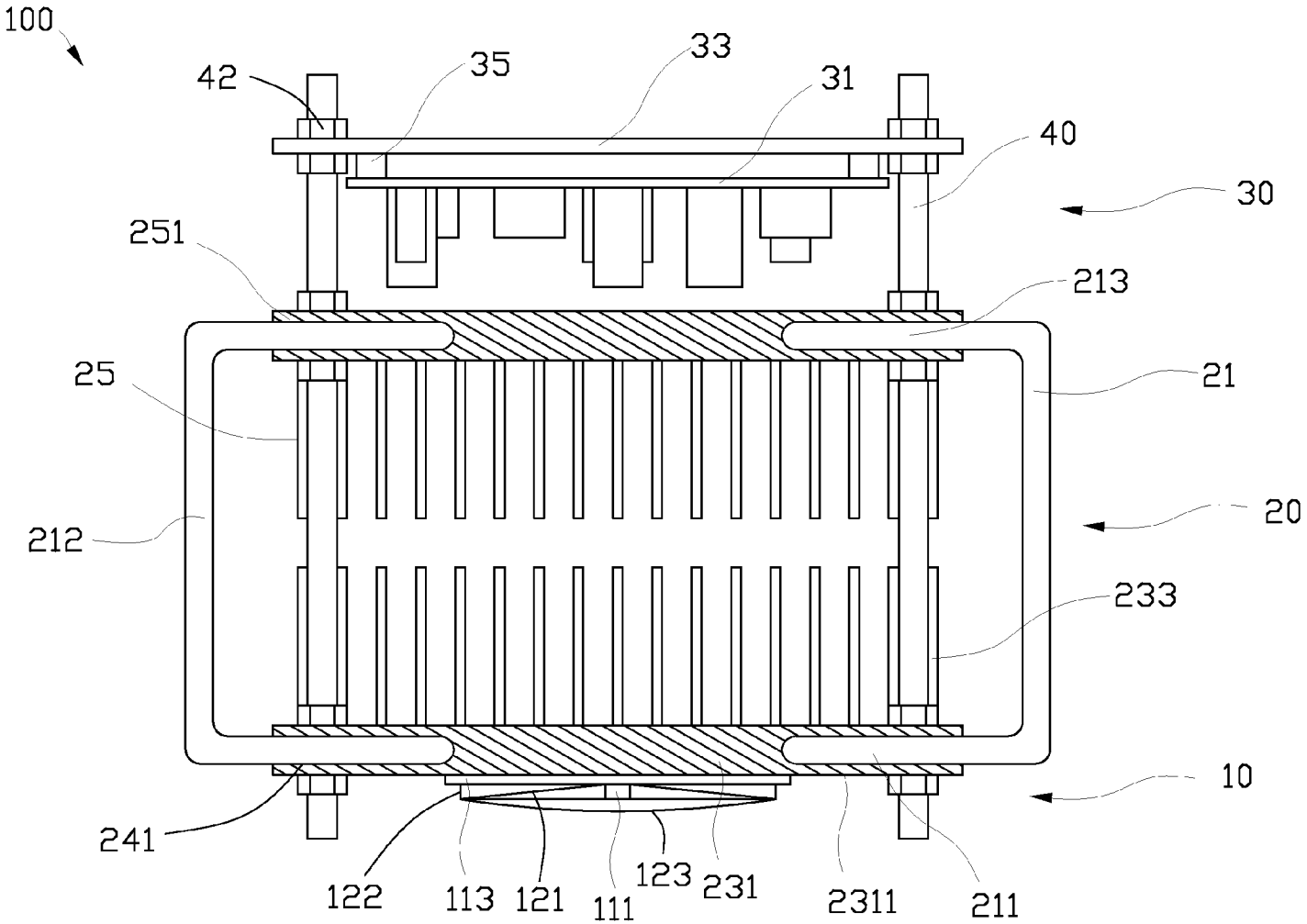
FIG. 2 is a cross-section of the LED illuminating device of FIG. 1.

Referring to FIGS. 1 and 2, an LED illuminating device 100 in accordance with a first embodiment of the disclosure is shown. The LED illuminating device 100 includes an optical section 10, an electrical section 30, and a heat dissipation section 20 arranged between the optical section 10 and the electrical section 30. The optical section 10 is disposed at a bottom end of the LED illuminating device 100, and the electrical section 30 is disposed at a top end of the LED illuminating device 100.

The optical section 10 includes a light source 11 and a light output housing 12 around the light source 11. The light source 11 includes a heat spreader 113 and an LED emitter 111 thermally attached to a bottom surface the heat spreader 113. A top surface of the heat spreader 113 is affixed to a bottom end of the heat dissipation section 20 for connecting the optical section 10 to the heat dissipation section 20. The light output housing 12 includes a light reflector 121, a casing 122 and an optical lens 123. The casing 122 surrounds the light source 11 and defines a circular light exit window at a bottom end thereof. The light reflector 121 is received in the casing 122. The optical lens 123 is located at the bottom end of the casing 122 and at the light exit window of the casing 122. The light reflector 121 has a reflective inner surface to redirect light from the emitter 111 towards the optical lens 123. The light reflector 121 and the optical lens 123 cooperatively provide luminescence characteristics for the light source 11, for example, directionality of the light source 11.

The heat dissipation section 20 includes a lower heat sink 23, an upper heat sink 25 located above and facing the lower heat sink 23, and a plurality of heat pipes 21 connected the lower heat sink 23 with the upper heat sink 25. The lower and upper heat sinks 23, 25 have size and shape the same with each other. The lower heat sink 23 includes a lower substrate 231 and a plurality of fins 233 extending perpendicularly and upwardly from a top surface of the lower substrate 231 towards the upper heat sink 25. The optical section 10 is mounted on a bottom surface of the lower substrate 231. The upper heat sink 25 includes an upper substrate 251 and a plurality of fins 253 extending perpendicularly and downwardly from a bottom surface of the upper substrate 251 towards the lower heat sink 23.

The lower and upper substrates 231, 251 each are rectangular. Four mounting holes 240 are defined in four corners of each of the lower and upper substrates 23, 25. Each of the mounting holes 240 extends vertically through a corresponding substrate 231 (251) from the top surface to the bottom surface of the corresponding substrate 231 (251). A plurality of receiving holes 241 are defined in the lower and upper substrates 231, 251. Each of the receiving holes 241 is a blind hole and extends horizontally inwardly from a lateral side of a corresponding substrate 231 (251) towards an opposite lateral side of the corresponding substrate 231 (251).

Each heat pipe 21 is "U" shaped and includes a straight adiabatic section 212, and an evaporating section 213 and a condensing section 211 extending perpendicularly from two opposite ends of the adiabatic section 212 towards the same direction, respectively. The evaporating sections 211 of the heat pipes 21 are embedded into the receiving holes 241 of the lower substrate 231, respectively, and connected with the lower substrate 231 by soldering. The condensing sections 213 of the heat pipes 21 are embedded into the receiving holes 241 of the upper substrate 251, respectively, and connected with the upper substrate 251 by soldering. The adiabatic sections 212 are exposed at opposite lateral sides of the heat dissipation section 20, respectively, and connect between the lower substrate 231 and the upper substrate 251. Accordingly, the lower and upper heat sinks 23, 25 are assembled together via the heat pipes 21. The optical section 10 is attached to a bottom surface 2311 of the lower substrate 231. The light source 11, the lower and upper heat sinks 23, 25 and the heat pipes 21 cooperatively form a light engine of the LED illuminating device 100.

The electrical section 30 provides drive power, control circuit and power management for the light source 11. The electrical section 30 includes a circuit board 31 and a cover plate 33 just above the circuit board 31. The cover plate 33 is rectangular, and has a size larger than the circuit board 31. The cover plate 33 and the circuit board 31 are spaced from each other. A plurality of fixing poles 35 are formed on a bottom surface of the cover plate 33 for connecting the circuit board 31 to the cover plate 33. The circuit board 31 electrically connects to a battery unit directly or a power source via a transformer. Furthermore, electric wires (not shown) extend through the heat dissipation section 20 and the heat spreader 113 to connect the emitter 111 with the circuit board 31. Four straight fixing holes 330 are defined in four corners of the cover plate 33, respectively. The fixing holes 330 are coaxial with the mounting holes 240 of the lower and upper substrates 231, 251, respectively. Four fasteners 40 are respectively extended through the fixing holes 330 of the cover plate 33 and the mounting holes 240 of the upper and lower substrates 251, 231 along a top-to-bottom direction of the LED illuminating device 100 for connecting the electrical section 30 and the light engine together.

In this embodiment, the fasteners 40 are poles each of which defines three threaded sections 42 corresponding to the fixing hole 330 of the cover plate 33, and the mounting hole 240 of the upper substrate 251 and the mounting hole 240 of the lower substrate 231, respectively. A diameter of each of the fixing holes 330 and the mounting holes 240 is slightly larger than a diameter of each of the threaded sections 42 of the fasteners 40. Thus, the threaded sections 42 of each fastener 40 are firstly loosely received in the fixing holes 330 of the cover plate 33, the mounting holes 240 of the upper substrate 251 and the mounting holes 240 of the lower substrate 231. Then a plurality of screw caps 41 screw onto the fastener 40 wherein each two screw caps 41 screw onto upper and bottom sides of a corresponding threaded section 42 to sandwich the cover plate 33, the upper substrate 251 and the lower substrate 231 between the each two screw caps 41.

In operation, the heat spreader 113 absorbs heat from the emitter 111; the heat is transferred the lower substrate 231 of the lower heat sink 23 and the evaporating sections 211 of the heat pipes 21 from the heat spreader 113 and is further spread to the fins 233 of the lower heat sink 23 and the upper heat sink 25 via the heat pipes 21; finally the heat is dissipated to ambient air via the lower heat sink 23 and the upper heat sink 25. Since the heat pipes 21 have excellent heat transfer performance due to their low thermal resistance, the heat generated by the emitter 111 absorbed by the evaporating sections 211 of the heat pipes 21 is quickly and effectively transferred to the upper heat sink 25, which is far away from the emitter 111, for providing effective heat dissipation to the emitter 111. Accordingly, the heat dissipation efficiency of the LED illuminating device 100 is improved.

Figure 3:
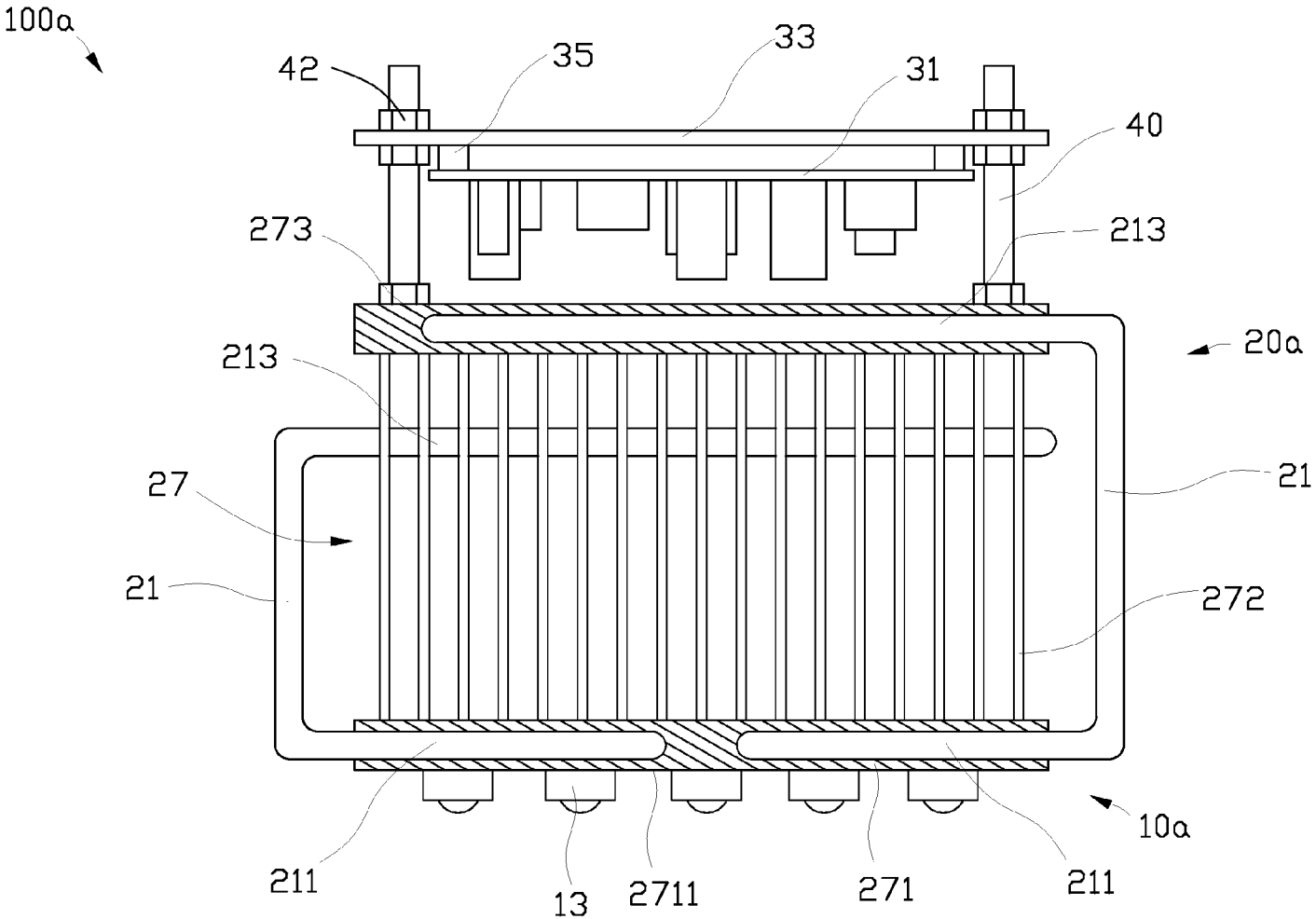
FIG. 3 is a cross-section of an LED illuminating device in accordance with a second embodiment.

FIG. 3 illustrates an LED illuminating device 100*a* according to a second embodiment of the disclosure. In the present embodiment, a heat dissipation section 20*a* of the LED illuminating device 100*a* includes only one heat sink 27 and two heat pipes 21, and an optical section 10*a* includes a plurality of emitters 13 directly mounted on the bottom end of the heat dissipation section 20*a*. The heat sink 27 includes a first substrate 271, a second substrate 273 being parallel to and spaced from the first substrate 271, and a plurality of fins 272 connected between the first substrate 271 and the second substrate 273. The second substrate 273 is located above the first substrate 271. Each of the first and second substrates 271, 273 is substantially rectangular. The emitters 13 are arrayed on a bottom surface 2711 of the first substrate 271. Thus, heat generated by the emitters 13 can be conducted to the first substrate 271 quickly via a direct contact between the emitters 13 and the bottom surface 2711 of the first substrate 271. The bottom surface 2711 of the first substrate 271 functions as a heat absorbing surface of the heat dissipation section 20*a*. Therefore, heat resistance between the emitters 13 and the heat dissipation section 20*a* is reduced. Each of the heat pipes 21 has substantially the same configuration as the heat pipes 21 of the first embodiment, only differing in that the condensing section 213 of right one of the heat pipes 21 is embedded into the second substrate 273, and the condensing section 213 of the left heat pipe 21 horizontally extends through a top end of each of the fins 272 and is connected to the fins 272.

Figure 4:
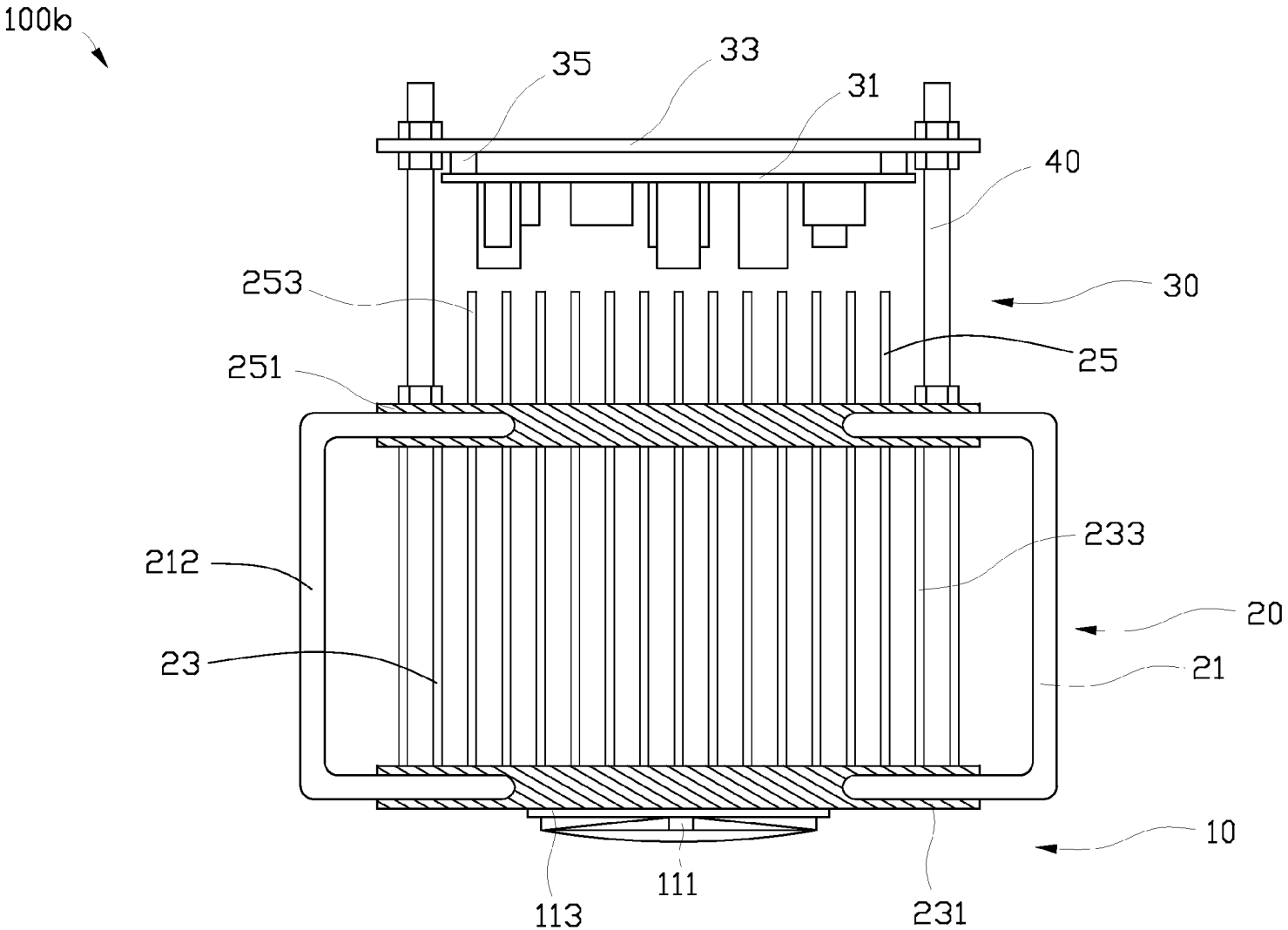
FIG. 4 is a cross-section of an LED illuminating device in accordance with a third embodiment.

FIG. 4 illustrates an LED illuminating device 100*b* according to a third embodiment of the disclosure, differing from the first embodiment only in the arrangement of the upper heat sink 25 and the lower heat sink 23. The upper substrate 251 of the upper heat sink 25 is located on and abuts top ends of the fins 233 of the lower heat sink 23, and the fins 253 of the upper heat sink 25 extend upwardly and perpendicularly from the upper substrate 251 far away from the lower substrate 231. The fins 253 of the upper heat sink 25 are located between the upper substrate 251 and the cover plate 33 of the electrical section 30. Therefore, the adiabatic section 212 of each heat pipe 21 between the lower and upper substrates 231, 251 of FIG. 4 is shorter with respect to the adiabatic section 212 of FIG. 2.

Figure 5:
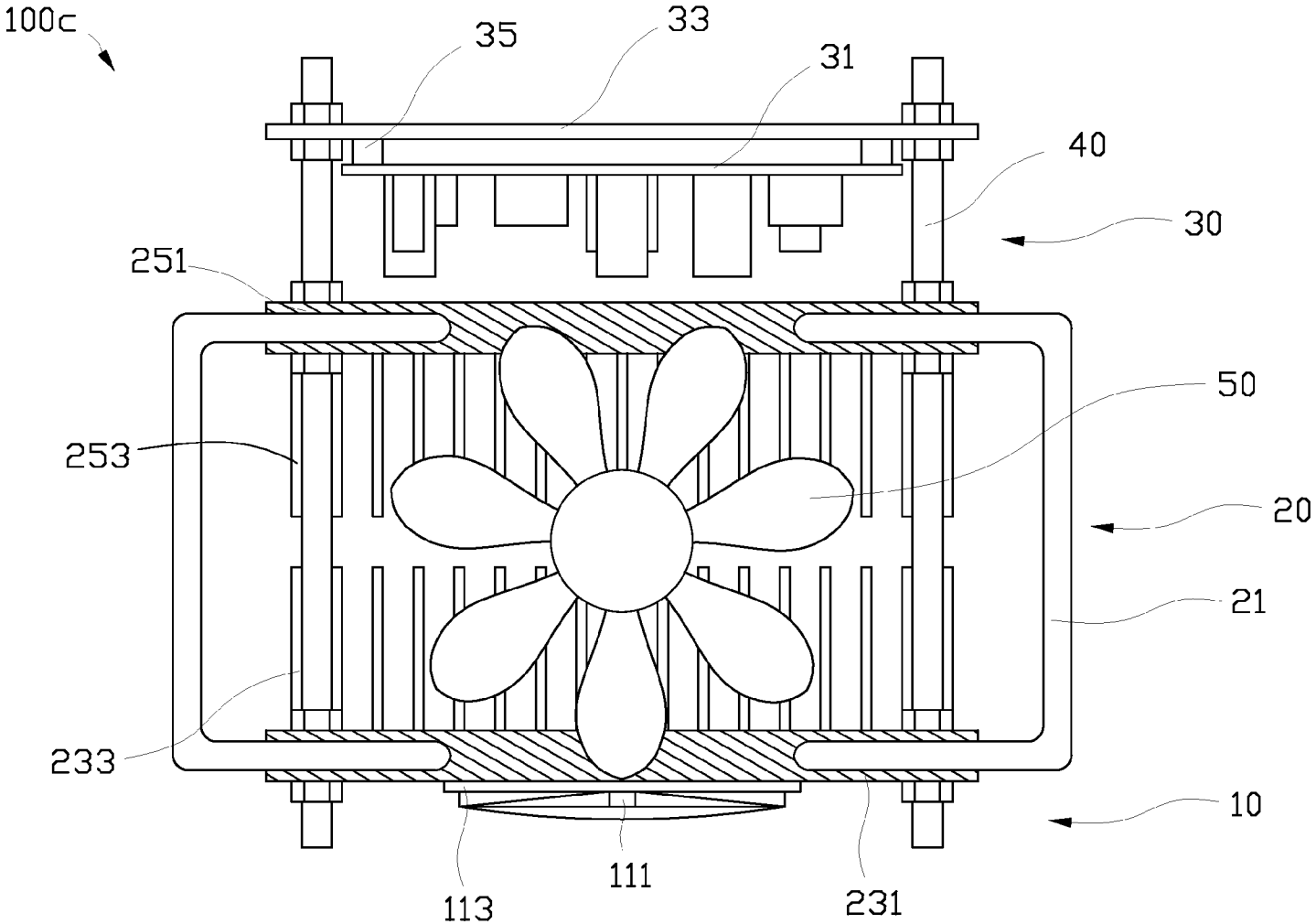
FIG. 5 is a cross-section of an LED illuminating device in accordance with a fourth embodiment.

FIG. 5 illustrates an LED illuminating device 100*c* according to a fourth embodiment of the disclosure, differing from the first embodiment only in that a cooling fan 50 is mounted on one side of the lower and upper heat sinks 23, 25 for providing forced airflow towards the fins 233, 253. The cooling fan 50 is arranged between the upper and lower substrates 251, 231. The cooling fan 50 generates currents of airflow flowing through the lower and upper heat sinks 23, 25, causing heat to be forcedly dissipated into ambient air for facilitating removal of heat from the LED illuminating device 100*c*.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED illuminating device, comprising:

an optical section at a bottom end of the LED illumination device, the optical section comprising at least an LED emitter;

an electrical section at a top end of the LED illumination device, the electrical section electrically connecting with the at least an LED emitter; and a heat dissipation section between the optical section and the electrical section, the heat dissipation section comprising:

an upper substrate and a lower substrate being parallel to and spaced from the upper substrate;

a plurality of fins arranged between the upper and lower substrates; and at least a heat pipe comprising an evaporating section connected to the lower substrate and a condensing section connected to the upper substrate, the at least an LED emitter thermally attached to the lower substrate, the at least a heat pipe transferring heat of the at least an LED emitter from the lower substrate to the upper substrate;

wherein the electrical section comprises a circuit board and a cover plate above and connected with the circuit board, the circuit board electrically connected to the at least an LED emitter; and wherein a plurality of mounting holes are defined in the upper and lower substrates, respectively, a plurality of fixing holes coaxial with the mounting holes being defined in the cover plate, a plurality of fasteners each extending through a corresponding fixing hole of the cover plate, a corresponding mounting hole of the upper substrate and a corresponding mounting hole of the lower substrate for connecting the electrical section and the heat dissipation section together, an area of the cover plate of the electrical section exceeding that of the circuit board, and a predetermined distance being defined between the cover plate and the heat dissipation section.

2. The LED illuminating device of claim 1, wherein the fins extend upwardly from the lower substrate towards the upper substrate, and the heat dissipation section further comprises a plurality of another fins extending downwardly from the upper substrate towards the lower substrate.

3. The LED illuminating device of claim 2, wherein at least a receiving hole is defined in the lower substrate for receiving the evaporating section of the at least a heat pipe therein, and at least a receiving hole is defined in the upper substrate for receiving the condensing section of the at least a heat pipe therein.

4. The LED illuminating device of claim 3, wherein each of the receiving holes is a blind hole and extends horizontally inwardly from a lateral side of a corresponding substrate towards an opposite lateral side of the corresponding substrate.

5. The LED illuminating device of claim 3, wherein the evaporating section and the condensing section of the at least a heat pipe are inserted into the receiving holes of the upper and lower substrates, respectively, and connected to the upper and lower substrates by soldering.

6. The LED illuminating device of claim 1, wherein the fins extend upwardly from the lower substrate towards the upper substrate, and the heat dissipation section further comprises a plurality of another fins extending upwardly from the upper substrate in a direction away from the lower substrate.

7. The LED illuminating device of claim 1, wherein a cooling fan is mounted at one side of the fins for providing a forced airflow towards the fins, the cooling fan being arranged between the upper and lower substrates.

8. The LED illuminating device of claim 1, wherein the optical section further comprises a heat spreader for the at least an LED emitter attached thereto and a light output housing around the at least an LED emitter, the light output housing comprising an optical lens at a light exit window thereof and a light reflector to redirect light from the at least an LED emitter towards the optical lens.

* * * * *